US005542370A

United States Patent [19]

Castleberry

[11] Patent Number: 5,542,370

[45] Date of Patent: Aug. 6, 1996

[54] PORTABLE FISHING DECK AND BOAT WITH FISHING DECK

[76] Inventor: Morris D. Castleberry, 528 Longview Rd., Ozark, Mo. 65721

[21] Appl. No.: 310,861

[22] Filed: Sep. 22, 1994

Related U.S. Application Data

[62] Division of Ser. No. 966,016, Oct. 23, 1992, abandoned.

[51] Int. Cl.[6] ..... B63B 7/04

[52] U.S. Cl. ..... 114/352; 114/77 R

[58] Field of Search ..... 114/352, 343, 114/61, 354, 77 R; 440/49, 53, 54, 6, 65

[56] References Cited

U.S. PATENT DOCUMENTS

| | | | |
|---|---|---|---|
| 727,894 | 5/1903 | Burton | 114/352 |
| 764,473 | 7/1904 | Kilgore | 114/352 |
| 3,129,443 | 4/1964 | Maturi et al. . | |
| 3,613,137 | 10/1971 | Eccles | 114/362 |
| 3,702,485 | 11/1972 | Thompson . | |
| 3,877,095 | 4/1975 | Ivy . | |
| 4,458,622 | 7/1984 | Anderson | 114/39.1 |
| 4,529,386 | 7/1985 | Smith | 440/54 |
| 4,695,260 | 9/1987 | Suzuki et al. | 440/61 |
| 4,742,795 | 5/1988 | Deprey | 114/362 |
| 4,870,919 | 10/1989 | Allison | 441/61 |
| 4,883,012 | 11/1989 | Kennedy | 114/61 |
| 4,936,238 | 6/1990 | Childress | 114/352 |
| 4,955,834 | 9/1990 | Henderson | 440/6 |
| 5,013,270 | 5/1991 | Walls | 441/45 |
| 5,037,338 | 8/1991 | Anderson et al. | 441/61 |
| 5,052,325 | 10/1991 | Rhines | 114/363 |
| 5,061,215 | 10/1991 | Walls | 441/45 |
| 5,112,258 | 5/1992 | Folson | 440/6 |
| 5,349,918 | 9/1994 | Elie | 114/352 |

*Primary Examiner*—Robert J. Oberleitner
*Assistant Examiner*—C. J. Bartz
*Attorney, Agent, or Firm*—Howelll & Haferkamp, L.C.

[57] ABSTRACT

A fishing deck kit provides for mounting a fishing deck including an elevated fisherman's chair and trolling motor to either the fore or aft end, or both ends of a pair of canoes or other pontoon members, or to a john boat or other single hulled boat. Also disclosed is a fishing boat and outboard motor with an aft mounted fishing deck. A hinged transom and power trim mechanism is also provided to facilitate mounting of an outboard motor for control by the fisherman without interfering with the mechanical arrangement for the aft fishing deck. The power trim includes limit switches for sensing an up position and a down position such that the outboard motor may be conveniently moved automatically from one position to the other under remote operator control. Alternately, the outboard motor may be manually moved between its up and down positions,

2 Claims, 4 Drawing Sheets

100
102
104
106
108
110
112
114
116
118
120
122
124
126

PORTABLE FISHING DECK AND BOAT WITH FISHING DECK

This is a divisional of application Ser. No. 07/966,016 filed on Oct. 23, 1992, now abandoned.

BACKGROUND AND SUMMARY OF THE INVENTION

There are many fishermen who fish from various kinds of boats, including canoes, john boats, and the like. With these boats, typically the fisherman will sit down in the boat, at or about water level, and cast his line or otherwise fish as is well-known in the art. For most kinds of fishing, it is much more desirable to sit in an elevated chair above the water to fish. This is desirable not only for comfort and safety, but also helps the fisherman look down into the water to spot fish as well as retrieve fish when caught. All in all, fishing from an elevated chair makes fishing much more pleasurable.

As is well-known to most fisherman, there are boats presently available, such as bass boats, which have elevated fishing chairs and decks for mounting electric trolling motors at the front of the boat to provide noiseless final positioning and trolling of the boat as the fisherman fishes. However, these bass boats can be quite expensive and, if purchased, obsolete a fisherman's first boat which may be a canoe, john boat or the like. Furthermore, the inventor is not aware of any fishing boats which have a fishing deck mounted to or built in behind the normal transom or outboard motor. One reason for this may be the problem with possible interference between the fishing deck and the outboard motor or propeller typically mounted to or extending rearward from the aft end of the boat.

In order to solve these and other problems in the prior art, and in order to provide a kit for converting a single hull or two single hull boats into a fishing boat having one or two fishing decks with elevated chairs, or for adding a second fishing deck to the back end of a boat, the inventor has succeeded in designing and developing a fishing deck and mount which accommodates the use of an outboard motor which is centrally located and which has the equivalent of a power trim mechanism. The inventor's rear fishing deck and/or power trim mechanism may also be conveniently incorporated into a new fishing boat at the time of its manufacture, and thus should not be merely thought of as an add-on kit. In essence, the inventor's device includes a platform-like fishing deck which may be mounted in a variety of ways to span a pair of canoes or other pontoon members across either their fore or aft end. A common decking may then be applied across the upper edges of the canoes to form a floor for the resultant boat, and a central cavity placed amidships accommodates the outboard motor typically used by these boat owners. The central cavity includes an angled transom with a hinged mount along with a hydraulic cylinder and a pair of limit switches which may be connected in series and operated with controls mounted on a control panel for selectively raising and lowering the outboard motor, as desired. This feature not only makes it possible for a fishing deck to be added to the aft end of a boat, but also eliminates the need for a separate power trim mechanism on the motor itself. The hinged transom, hinged at either the top or bottom thereof, facilitates the positioning of the rear deck and reduces the expense of a manufactured outboard motor by eliminating the need for the raise and lower mechanism normally built into outboard motors. As an alternative to the inventor's power trim, a manual or hydraulically operated lift may be used.

In a second embodiment, the fishing deck of the present invention may be conveniently mounted at the fore and aft ends of a john boat or other single-hulled boat, with a central cavity formed in the fishing deck at the aft end of the boat for mounting of the outboard motor. Thus, in this embodiment, the aft fishing deck surrounds the outboard motor. Alternately, for inboard motor boats, no central cavity need be provided and the aft deck kit need only match the boat's hull contour. As with the first embodiment, the power trim arrangement may also be provided for ease in operation of the outboard motor.

While the principal advantages and features of the present invention have been briefly described above, a greater understanding of the novel and unique features of the invention may be attained by referring to the drawings and detailed description of the preferred embodiment which follow.

DETAILED DESCRIPTION OF THE PREFERRED EMBODIMENTS

Figure 1:
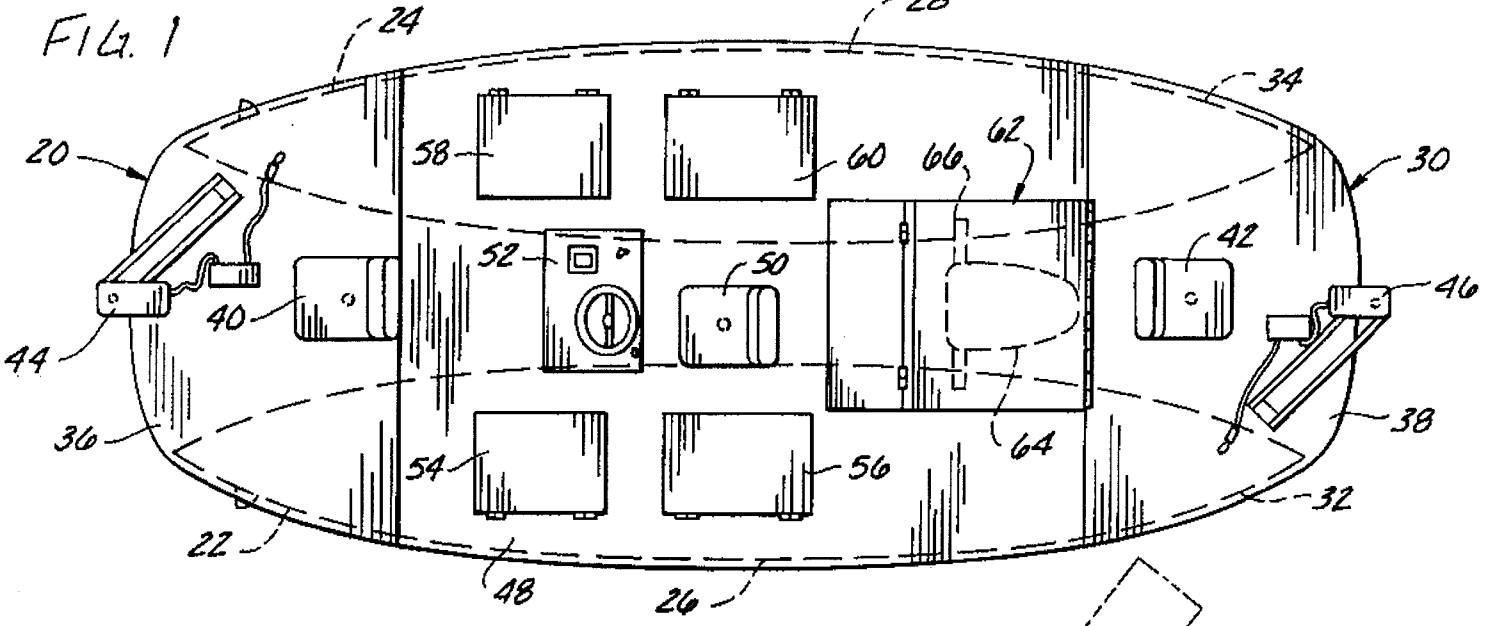
FIG. 1 is a plan view of the fishing deck kit of the present invention applied both to the fore and aft ends of a pair of canoes.
Figure 2:
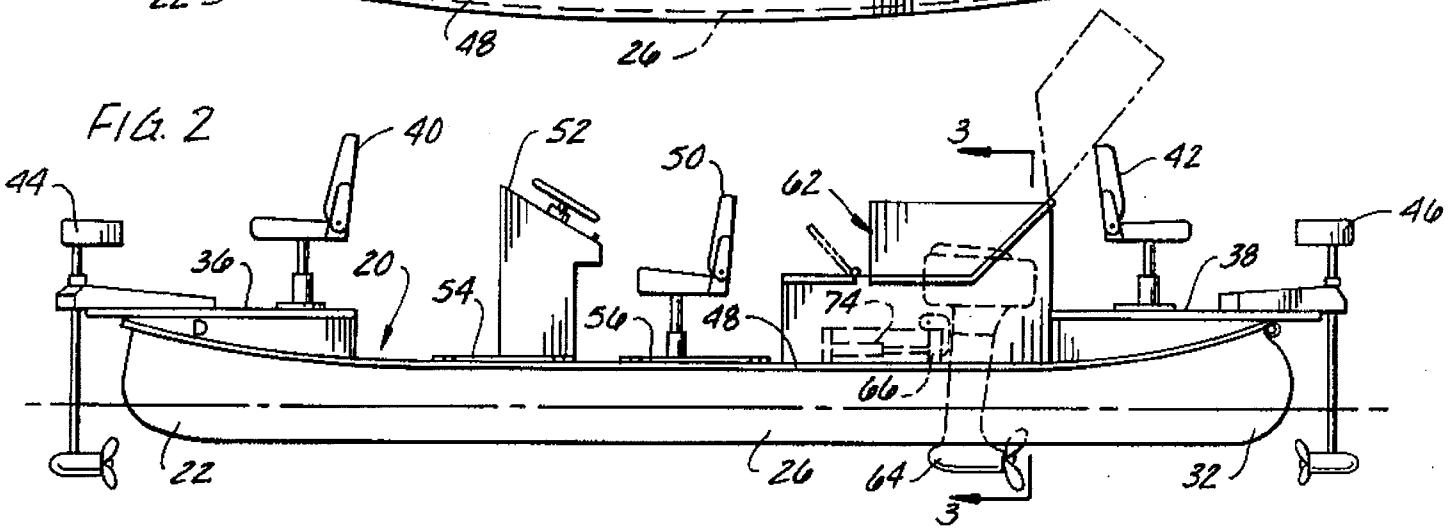
FIG. 2 is a side view of the fishing boat constructed with the fishing deck kits of the present invention, as shown in FIG. 1.

As shown in FIGS. 1 and 2, a first fishing deck 20 may be added to and span the fore ends 22, 24 of a pair of canoes 26, 28 and a second fishing deck 30 may be mounted to and span the upper surface of the aft ends 32, 34 of canoes 26, 28. Each fishing deck 20, 30 has a floor 36, 38 which is elevated above the top of the canoes 26, 28 and which serves as a convenient mounting platform for an elevated chair 40, 42 and an electric trolling motor 44, 46. Additionally, a center flooring 48 also spans across the tops of canoes 26, 28 and provides a central platform for mounting of a captain's chair 50 and a control panel 52. Four hatches 54–60 provide easy access to the interiors of canoes 26, 28. It is anticipated that batteries or the like may be conveniently stored therein to provide power for the various electrical devices included in the boat, such as trolling motors 44, 46. At the rear of platform 48 is a central cavity with a covered housing 62 which provides the mounting location for an outboard motor 64 as is shown in greater detail in FIGS. 3–6. Thus, with the present invention, a pair of canoes 26, 28 may be conveniently covered with a central platform 48 and a pair of fishing decks 20, 30 to provide an overall level decking surface with elevated platforms for the mounting of fishing chairs 40, 42 and trolling motors 44, 46. A captain's chair 50 and control panel 52 provide for central control and operation of the fishing boat and controls may be conveniently included to operate both of the trolling motors 44, 46 as well as the outboard motor 64. Further details of the hinged transom and power trim will now be explained.

Figure 3:
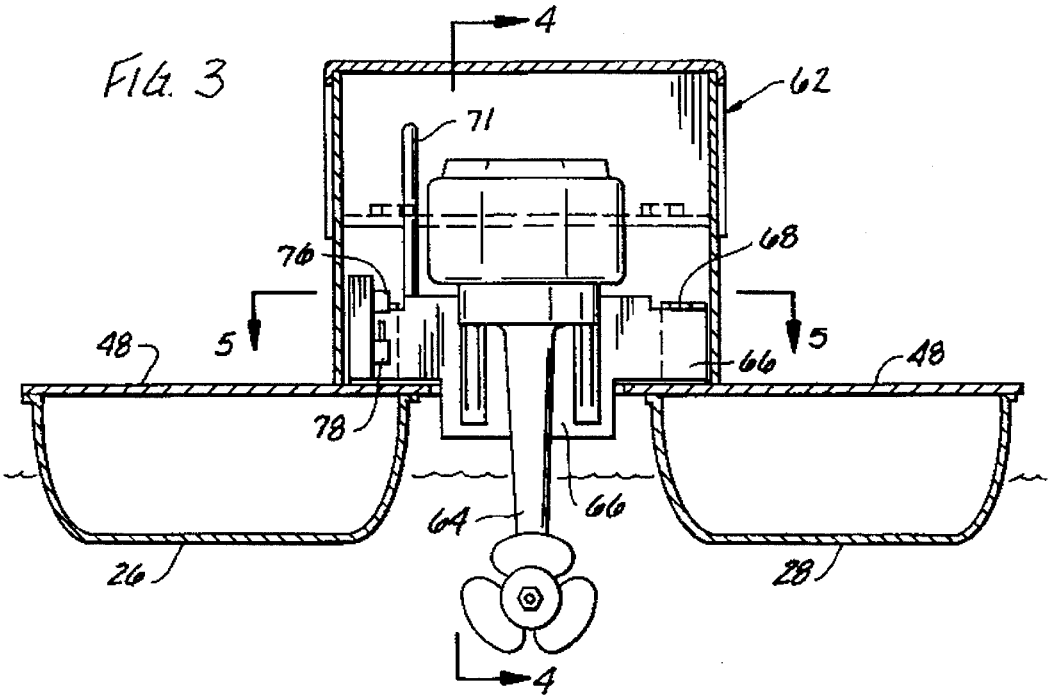
FIG. 3 is a cross sectional view taken along the plane of line 3—3 in FIG. 2 and detailing the hinged transom mounting the outboard motor between the parallel spaced apart canoes.
Figure 4:
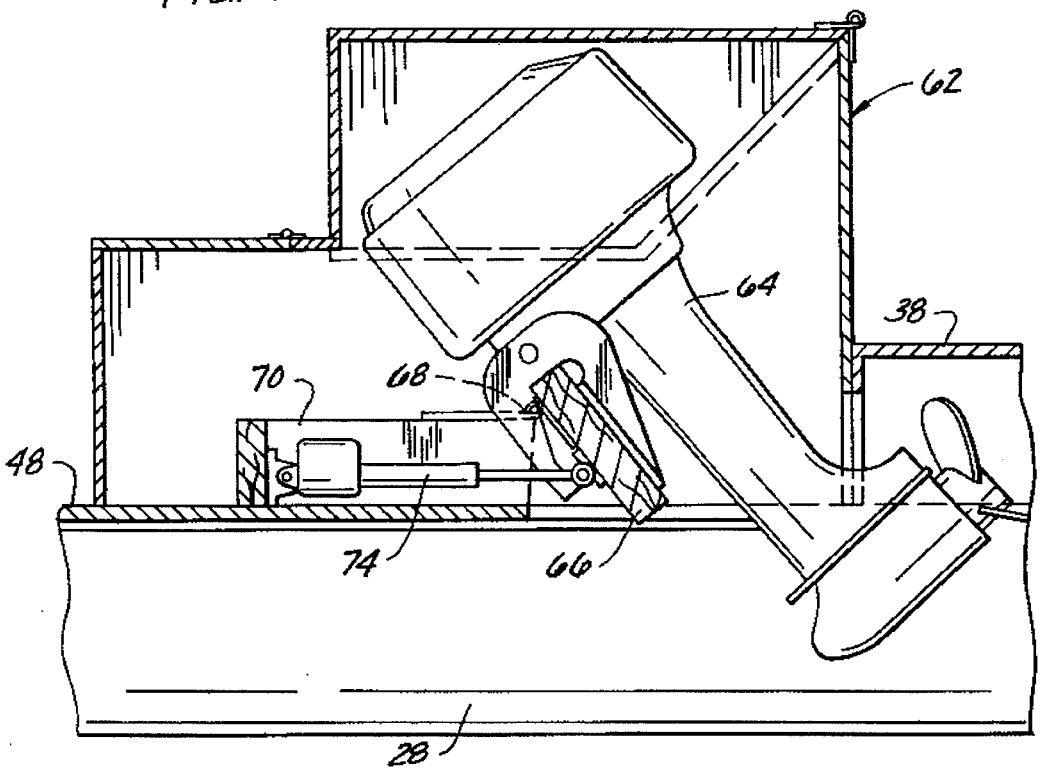
FIG. 4 is a partial cross sectional view taken along the plane of line 4—4 in FIG. 3 and further detailing the hinged transom mounting of the outboard motor with the power trim feature.
Figure 5:
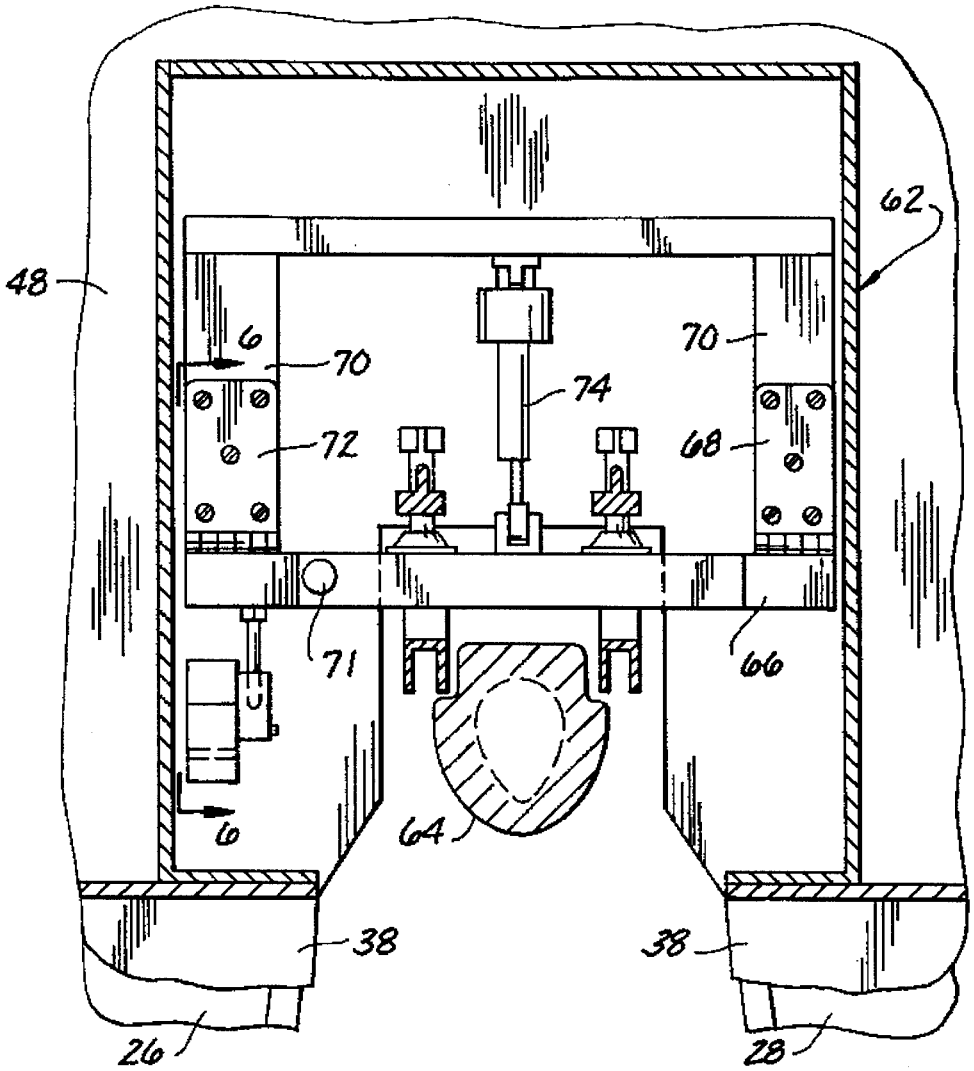
FIG. 5 is a partial cross sectional view taken along the plane of line 5—5 in FIG. 3 further detailing the hinged transom mounting for the outboard power motor.
Figure 6:
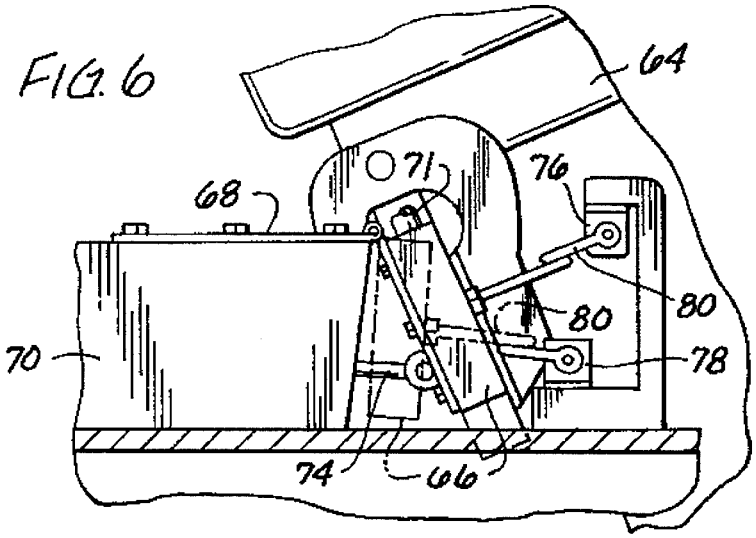
FIG. 6 is a partial cross sectional view taken along the plane of line 6—6 in FIG. 5 further detailing the hinged transom mounting along with the limit switch positioners.
Figures 7, 8, 9, 10:
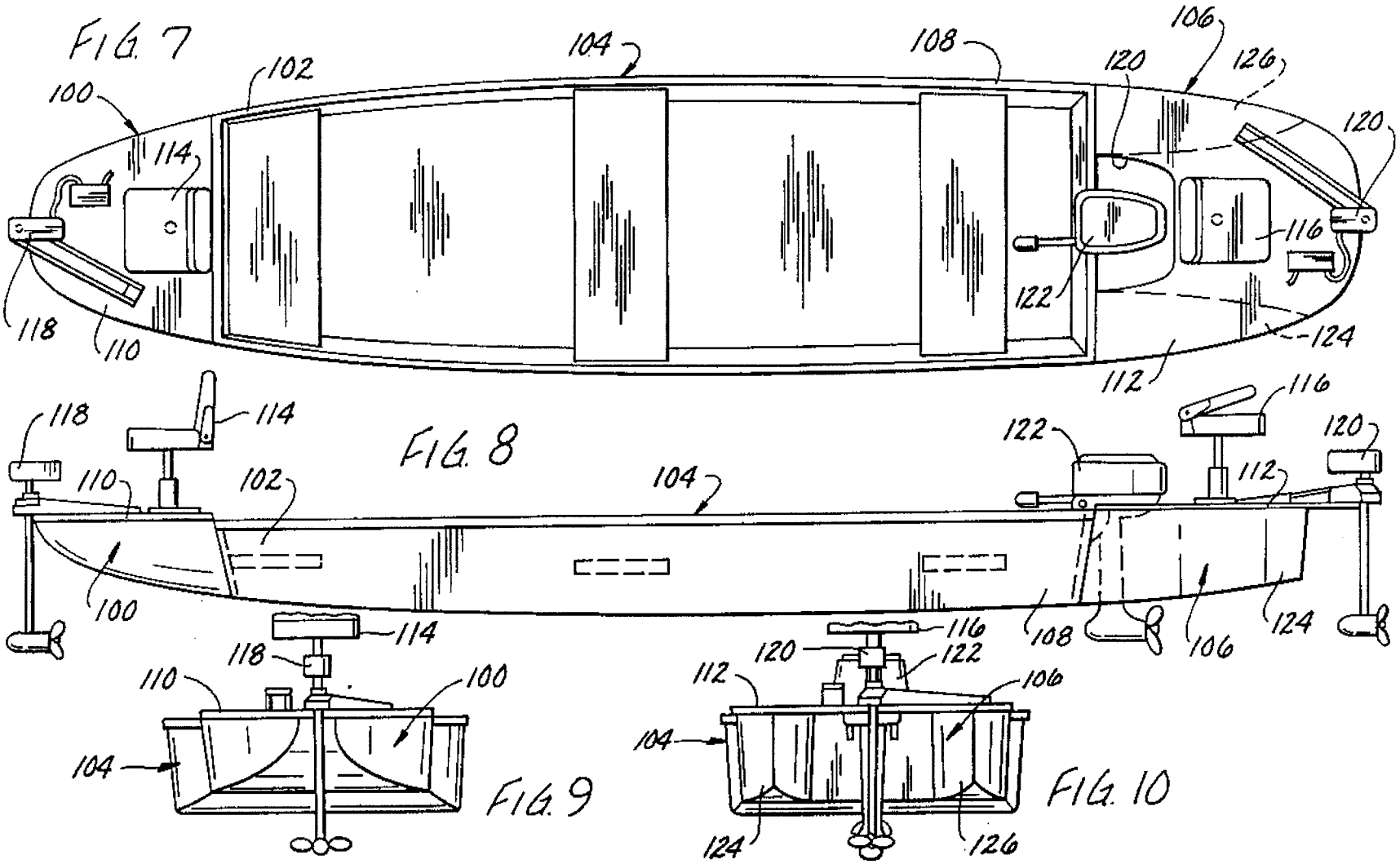
FIG. 7 is a plan view of an alternate embodiment of the fishing deck kit of the present invention as mounted to the fore and aft ends of a john boat.
FIG. 8 is a side view of the fishing boat with fishing decks mounted thereon depicted in FIG. 7.
FIG. 9 is a front view of the fishing boat constructed with the fishing deck kit of the second embodiment.
FIG. 10 is a rear view of the fishing boat constructed with the fishing deck kit of the second embodiment.

As best shown in FIGS. 3–6, the outboard motor 64 is mounted to a board 66 which is itself mounted by a hinge 68 to a platform 70. As shown in FIG. 3, a handle 71 may be used to manually move the outboard motor 64 between an upper, retracted position and a lower, operational position. An appropriate catch or locking mechanism, as is well known to those of ordinary skill in the art, may be used to secure the motor 64 in either of those two positions. As shown in FIG. 5, the outside edges of board 66 may be separately hinged by hinges 68, 72. A hydraulic cylinder 74 extends between boards 66 and a back plate 74 and provides a means for moving the outboard motor 64 and board 66 about hinges 68, 72 to raise and lower outboard motor 64, as desired. As best shown in FIG. 6, a pair of limit switches 76, 78 are lever actuated by a limit switch operator 80 which is mounted to board 66 and extends rearward therefrom. Limit switches 76, 78 define the up and down positions, respectively for outboard motor 64. Limit switches 76, 78 are connected in series with an electrical control for a hydraulic cylinder 74, as is well-known in the art, in order to achieve this automatic positioning as the hydraulic cylinder 74 is actuated to move the outboard motor 64 between these two defined positions.

A second embodiment is shown in FIGS. 7–10 and, generally, depicts the invention as mounted to a john boat. However, it should be understood that the invention may be just as readily adopted to any other single hull boat to the same effect. More particularly, as shown in the drawings, a first fishing deck 100 is mounted at the fore end 102 of john boat 104 and a second fishing deck 106 is mounted to the aft end 108. As in the first embodiment, each of the fishing decks 100, 106 have an upper deck 110, 112 for supporting a fisherman's chair 114, 116 and an electric trolling motor 118, 120. However, in this embodiment, each of the fishing decks 100, 106 have their own hull instead of straddling and being supported by the john boat 104 or other pontoon member such as the canoes 26, 28. Each fishing deck 100, 106 may be conveniently joined to the fore end 102, or aft end 108, by using any means as is well-known in the art, such as screws and glue, etc. With the aft end fishing deck 106, a cutout 120 permits direct mounting of the outboard motor 122 to the john boat 104, as is well-known in the art. Alternately, the hinged transom as shown in the first embodiment, along with the power trim, may just as easily be provided with slight mechanical modifications as would be apparent to one of ordinary skill in the art. Additionally, the aft mounted fishing deck 106 includes twin hulls 124, 126.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A kit for adding a fishing deck to a single hulled boat, said fishing deck having a hull, said fishing deck hull being twin-hulled and having a side formed at an angle to substantially match and line up with either the fore or aft of said boat, and being adapted for mounting to the aft of said boat, said fishing deck hull further comprising a cutout extending substantially vertically therethrough at said side to provide sufficient space for direct mounting of a motor to the aft of said boat, a bottom formed at an angle to substantially match and line up with the bottom of said boat, said fishing deck including a chair mounted thereon, and means for mounting a trolling motor thereto.

2. A portable fishing deck for attachment to a boat, the boat including a hull having opposing fore and aft ends and means for propulsion thereof, said fishing deck comprising a hull and a fishing platform mounted atop said fishing deck hull, said fishing deck including a cutout for straddling said propulsion means and said fishing deck hull comprising twin hulls, said twin hulls straddling said cutout, said fishing deck being configured to mount to either the fore or aft end of the boat hull.

* * * * *